US006773662B2

(12) United States Patent
Fisher et al.

(10) Patent No.: US 6,773,662 B2
(45) Date of Patent: Aug. 10, 2004

(54) HOT-WORKING STEEL ARTICLE

(75) Inventors: Kay Fisher, Leoben (AT); Herbert Schweiger, Wartberg (AT)

(73) Assignee: Böhler Edelstahl GmbH & Co KG, Kapfenberg (AT)

( * ) Notice: Subject to any disclaimer, the term of this patent is extended or adjusted under 35 U.S.C. 154(b) by 35 days.

(21) Appl. No.: 10/261,768

(22) Filed: Oct. 2, 2002

(65) Prior Publication Data

US 2003/0098097 A1 May 29, 2003

(30) Foreign Application Priority Data

Oct. 3, 2001 (AT) ..... 1565/01

(51) Int. Cl.[7] ..... C22C 38/24; C22C 38/22; C21D 9/00

(52) U.S. Cl. ..... 420/111; 148/334; 148/579

(58) Field of Search ..... 420/111; 148/334, 148/662, 579, 660, 654, 653

(56) References Cited

U.S. PATENT DOCUMENTS 4,853,181 A 8/1989 Wert et al.
5,651,842 A * 7/1997 Nakamura et al. ..... 148/321
6,015,446 A 1/2000 Rochl
6,024,916 A * 2/2000 Urita et al. ..... 420/110

FOREIGN PATENT DOCUMENTS

| | | |
|---|---|---|
| AT | 403058 | 11/1997 |
| EP | 0249855 | 10/1991 |
| EP | 0632139 | 1/1995 |
| EP | 0939140 | 9/1999 |
| WO | 00/26427 | 5/2000 |

OTHER PUBLICATIONS

Uncertified English Translation of Abstract of AT 403 058 B.
English Language Abstract of EP 0 632 139.
English Language Abstract of EP 0 939 140.
Stahl.Eisen Prüfblätter (SEP) 1314; Apr. 1990.
DIN EN 10 045; Apr. 1991.

* cited by examiner

*Primary Examiner*—Deborah Yee
(74) *Attorney, Agent, or Firm*—Greenblum & Bernstein, P.L.C.

(57) ABSTRACT

A hot-working steel article, e.g., tool, comprising a material which comprises, in % by weight, 0.451 to 0.598 C, 0.11 to 0.29 Si, 0.11 to 0.39 Mn, 4.2 to 4.98 Cr, 2.81 to 3.29 Mo, 0.41 to 0.69 V, with the balance iron, contaminants and accompanying elements, as well as an alloy and a process for making said article.

47 Claims, 1 Drawing Sheet

HOT-WORKING STEEL ARTICLE

CROSS-REFERENCE TO RELATED APPLICATIONS

The present application claims priority under 35 U.S.C. § 119 of Austrian Patent Application No. 1565/2001, filed on Oct. 3, 2001, the disclosure of which is expressly incorporated by reference herein in its entirety.

BACKGROUND OF THE INVENTION

1. Field of the Invention

The invention relates to a hot-working steel article, in particular, a tool for forming metals and alloys at elevated temperatures. Components, above all tools, that are stressed at elevated temperatures, e.g., extrusion die matrices, forging tools, die casting dies, extrusion dies, mandrels and the like, require materials which have mechanical properties commensurate with the intended stress at temperatures of, if necessary, 550° C. and higher and which retain these properties during an extended operating time.

2. Discussion of Background Information

By working according to the prior art, however, a high hardness and toughness of the material, a low plastic deformation under extreme stresses, high wear resistance, retention of hardness and good fatigue strength properties of a hot-working steel in the temperature range of above 550° C. cannot be achieved simultaneously to the desired extent by alloying technology methods. At given thermal and mechanical strains, the chemical composition and thermal treatment of an article (e.g., tool) should thus be selected such that the profile of the material properties achievable thereby comes as close as possible to meeting all requirements, although a shorter service life of the article often has to be accepted in this case.

For a long time materials science has been faced with the problem of improving the long-term use properties at elevated temperature of articles made of hot-working steel and of providing an alloy with which a high toughness of the material in combination with a high degree of hardness thereof can be achieved by a thermal treatment, so that the risk of fracture, even with shock like strain of a piece, and the plastic deformation and wear are minimized thereby. In that regard, the retention of hardness and the heat conductivity of the material also are to be taken into consideration.

One skilled in the art is aware that retention of hardness and unchanged maintenance of the mechanical properties at elevated temperature of a thermally treated steel article are accomplished by special carbides that can develop at carbon concentrations in the range of 0.5% by weight and with chromium contents of 3 to 5% by weight Cr of the alloy, with molybdenum-tungsten and vanadium contents further increasing the heat resistance thereof. The common hot-working steels essentially have contents, in % by weight, of 0.35 to 0.665 C, 2.0 to 7.0 Cr, 1.5 to 8.0 Mo and/or 1.5 to 18.0 W and 0.4 to 2.0 V, where vanadium can be replaced by higher molybdenum or, in particular, by higher tungsten concentrations.

In order to achieve a high hardenability of the hot-working steel with good retention of hardness and wear resistance even when thermally treating articles of large diameter, EP 0249855 suggests to use a steel composition of essentially, in % by weight, C=0.42 to 0.5, Mn=0.35 to 0.6, Si=0.8 to 1.2, Cr=5.8 to 6.2, Mo=1.85 to 1.95, V=0.7 to 0.9. An improvement in toughness, hardness, strength and wear resistance is achieved with the above alloy composition compared to a steel according to AISI type H 13. However, tempering to a hardness of more than 58 HRC causes a coarse grain formation of the microstructure and disadvantageous losses in toughness.

In order to improve the mechanical high-temperature properties, in particular under cyclical strain, the use of a cobalt-containing hot-working steel produced by powder metallurgy (U.S. Pat. No. 6,015,446) has also been proposed.

It is known from AT 403 058 to use a hot-working steel with increased aluminum contents for tools for the non-cutting heat-shaping of metals and alloys. This steel, although quite suitable for elevated working temperatures, exhibits an embrittlement tendency at hardness values above 58 HRC.

An alloy consisting essentially, in % by weight, of C=0.3 to 0.5, Si<0.9, Mn<1.0, Cr=2.0 to 4.0, Mo=3.5 to 7.0, 0.3 to 1.5 V and/or Ti and/or Nb, Al=0.005 to 0.1 is proposed in EP 0632139 as a material for hot-working tools that must have a heat conductivity of more than 35 W/m K, in order to thereby achieve a lower stress on the tool surface and a flatter temperature gradient within the tool to avoid thermoshock- and tension cracks.

EP 0939140 discloses a hot-working steel consisting essentially of, in % by weight, C=0.25 to 0.79, Cr=1.10 to 7.95, Mo=0.56 to 3.49, V=0.26 to 1.48, Fe=balance. In the above alloy the contaminants and accompanying elements are restricted to improve the properties of the formed material at high temperatures. High values for the high-temperature strength, the high-temperature toughness and the high-temperature wear resistance are achieved with this measure after a thermal treatment of the material to a hardness of lower than HRC=56, but a strong scattering of the values of the respective mechanical properties was detected at high temperature after thermal treatment to a hardness of the article of higher than 58 HRC.

A powder metallurgically produced hot-working steel that is characterized by a content of 1.5 to 2.5% by volume of carbides of the MC type is known from WO 00/26427. At hardness values above 58 to 59 HRC, at which tools are increasingly to be provided for cold forming, higher as well as lower MC contents than 2.5 to 1.5% by volume have a detrimental effect on the flexural impact strength.

The disclosures of all documents mentioned above are hereby expressly incorporated by reference herein in their entireties.

It would be desirable to eliminate the shortcomings in the above prior art and to provide a hot-working steel article that with high degrees of material hardness and similar strength properties simultaneously ensures toughness values at a considerably higher level and, in combination with good heat conductivity, provides an improved wear resistance at elevated temperatures and an effective prolongation of the service life of the part under intensified and, optionally, shock like stresses.

SUMMARY OF THE INVENTION

The present invention provides a hot-working steel article comprising a material which comprises, in % by weight, 0.451 to 0.598 carbon, 0.11 to 0.29 silicon, 0.11 to 0.39 manganese, 4.21 to 4.98 chromium, 2.81 to 3.29 molybdenum, 0.41 to 0.69 vanadium, with the balance being iron, contaminants and accompanying elements. (Unless stated otherwise, the weight percentages given herein are based on the total composition.)

In one aspect, the ratio C/V of the material is 0.82 to 1.38. In another aspect, the ratio (Cr+Mo+V)/C is 15.2 to 18.4. In yet another aspect, the material comprises less than 0.1% by weight of W. In a still further aspect of the article, the content of carbides which are formed upon solidification of a melt on which the material is based is less than 0.45 vol.-%.

Furthermore, the material may comprise not more than 0.005% by weight of sulfur and/or not more than 0.007% by weight of phosphorus and/or not more than a total of 0.010% by weight of (sulfur+phosphorus) and/or not more than 0.15% by weight of nickel and/or not more than 0.1% by weight of cobalt and/or not more than 0.1% by weight of copper and/or not more than a total of 0.25% by weight of (nickel+cobalt+copper) and/or not more than 0.02% by weight of aluminum and/or not more than 0.001% by weight of magnesium and/or not more than 0.001% by weight of calcium and/or not more than a total of 0.02% by weight of (aluminum+magnesium+calcium). As used herein and unless stated otherwise, the phrase "not more than" in combination with weight percentages includes 0% by weight, i.e., absence of the respective component. Also, it should be understood that the values of the weight percentages given herein are approximate values, i.e., not limited to the exact values stated.

In another aspect of the article, the material comprises less than 0.025% by weight of nitrogen. In still another aspect, the material comprises not more than 0.005% by weight of arsenic and/or not more than 0.003% by weight of bismuth and/or not more than 0.005% by weight of tin and/or not more than 0.002% by weight of zinc and/or not more than 0.002% by weight of antimony and/or not more than 0.002% by weight of boron and/or not more than a total of 0.009% by weight of (arsenic+bismuth+tin+zinc+antimony+boron).

Furthermore, the material may have a hardness of at least 58 HRC, an impact strength of at least 170 J and a notched impact strength (Charpy U) in longitudinal direction of at least 11 J. For example, the material may have a hardness of at least 59 HRC at room temperature, and at a temperature of 500° C. it may have an impact strength of at least 180 J and a notched impact strength (Charpy U) in longitudinal direction of at least 14 J. (The impact strength is determined according to "Stahl.Eisen-Prüfblätter" (SEP) 1314 (Steel Test Specification), the determination of the notched impact strength is to be carried out according to DIN EN 10045. Both documents are hereby expressly incorporated herein by reference in their entireties).

The material may have been heat-treated at a temperature below 1080° C., for example, at a temperature in the range of 1040° to 1060° C.

The article may be a tool, in particular, a tool for forming metals and alloys at elevated temperatures. For example, it may be selected from extrusion die matrices, forging tools, die casting dies, extrusion dies, and mandrels.

The present invention also provides an alloy for a hot-working steel article. The alloy comprises, in % by weight, 0.451 to 0.598 carbon, 0.11 to 0.29 silicon, 0.11 to 0.39 manganese, 4.21 to 4.98 chromium, 2.81 to 3.29 molybdenum, 0.41 to 0.69 vanadium, with the balance being iron, contaminants and accompanying elements. Further aspects of this alloy are those indicated above with respect to the material of the article of the present invention.

Furthermore, the present invention provides a process for making a hot-working steel article. According to said process, an article comprising a material which comprises, in % by weight, 0.451 to 0.598 carbon, 0.11 to 0.29 silicon, 0.11 to 0.39 manganese, 4.21 to 4.98 chromium, 2.81 to 3.29 molybdenum, 0.41 to 0.69 vanadium, with the balance being iron, contaminants and accompanying elements, is heat-treated at a temperature below 1080° C. to a hardness of the material of at least 58 HRC, an impact strength of at least 170 J and a notched impact strength (Charpy U) in longitudinal direction of at least 11 J.

In one aspect of this process, the temperature for the heat treatment is in the range of 1040° to 1060° C. In a further aspect, the article is heat-treated to a hardness of the material of at least 59 HRC at room temperature, and an impact strength of at least 180 J and/or a notched impact strength (Charpy U) in longitudinal direction of at least 14 J, both at a temperature of 500° C. Further aspects of this process are those indicated above with respect to the material of the article of the present invention.

The advantages achieved with the invention essentially are that a solid solution hardening with a low proportion of carbides is made possible through the alloying technique or through a respective balanced concentration of carbon and the carbide-forming elements in the steel, respectively. A hardening to values above 58 HRC can be performed at lower austenization temperatures, e.g., of 1080° C. or lower, corresponding to the dissolution of carbon proceeding more readily, which promotes the fine-grain quality of the material and is advantageous with respect to a high toughness of the material. In other words, it has been found that certain concentrations within selected limits of carbon and of the elements forming special carbides and monocarbides promote a desired solid solution hardenability and suppress a carbide hardening or a hardness-increasing separation of coarser carbides at the expense of the matrix hardness, respectively, during thermal treatment.

According to the invention it is important, due to the interactions of the elements, or better, the activities of the reacting elements, to match them with one another. A carbon content of at least 0.451% by weight ensures the minimum activity of carbon for distorting the lattice of the matrix crystals and a carbide-forming tendency at the provided chromium, molybdenum and vanadium concentrations. Carbon contents of the alloy of higher than 0.598% by weight, although promoting the wear resistance, may have a disadvantageous effect on the hardness and toughness of the article. The chromium content should synergistically be set between 4.21 and 4.98% by weight. Cr concentrations that are higher than 4.98% by weight may shift the retention of hardness of the hot-working steel towards lower temperatures, while chromium values lower than 4.21% by weight may cause a reduced tendency to form special carbides. The activity of molybdenum and vanadium with respect to carbon, which is determined by the contents thereof, is of significance in view of the matrix hardening during thermal treatment. It has been found that Mo has a kind of masking effect on V and, at contents of at least 2.81% by weight, retards VC monocarbide separation and, thus a matrix depletion. On the other hand, with molybdenum contents higher than 3.29% by weight, the affinity towards carbon is so high that a dissolution of the same during austenization of the article may be significantly retarded or reduced. A minimum content of 0.41% by weight of V is desirable for a corresponding development of the secondary hardness during tempering of the hot-working steel article; contents of V higher than 0.69% by weight may increase the tendency to form monocarbides, which, as has been found, can also have a negative impact with respect to a reduction of the heat conductivity of the steel. Silicon in concentrations between 0.11 and 0.29% by weight is desirable for an efficient deoxidation of the liquid steel. Si contents higher than 0.29% by weight may impair the material toughness at the intended use temperatures. Manganese is provided for binding the sulfur. When using modern desulfurization methods, it may be possible to keep the manganese contents as low as 0.11% by weight. Manganese concentrations higher than 0.39% by weight may impair the high-temperature toughness of the steel, in particular, in combination with further grain boundary active elements.

It can be seen from the above statements that a synergistic selection of the respective concentrations of carbon, silicon, manganese, chromium, molybdenum and vanadium according to the invention provides a hot-working steel article with a high degree of hardness of 58 HRC and higher and, at the same time, a superior toughness through thermal treatment.

It is advantageous for the contents of carbon and vanadium to be selected such that the ratio: concentration of V divided by that of C equals 0.82 to 1.38. Through this ratio within the stated range, monocarbide formation is suppressed, in terms of formation-kinetics, in favor of the matrix content, and the solid solution hardenability is favored.

An increase in hardness in combination with an increased retention of hardness, an improved high-temperature wear resistance and service life of a hot-working steel article can be achieved if the ratio of the concentrations of chromium+molybdenum+vanadium divided by the carbon content is between 15.2 and 18.4.

Very surprisingly, because molybdenum and tungsten are considered interchangeable as far as their tendency to form carbides is concerned, it was found that tungsten promotes the tendency to form primary carbides and, in particular, favors segregations and possibly, grain growth, where a reduction in segregations by annealing of the hot-working steel is considerably reduced by tungsten. According to the invention, the tungsten content of the hot-working steel article desirably is selected to be less than 0.1% by weight.

The hot-working steel article preferably has a proportion of carbides formed in the melt during the solidification thereof of less than 0.45% by volume. On the one hand, a depletion of the solid solutions with respect to carbon seems to be prevented and a further increase in hardness seems to be attainable thereby and, on the other hand, as was found, an increase in the heat conductivity of the hot-working steel article may be achieved. An improvement in the heat conductivity by means of a reduction of the carbide proportion in the material has not yet been scientifically ascertained, but might be due to interface kinetics and/or the properties of the carbides.

In a further embodiment of the invention, a reduction of the contaminants and/or accompanying elements which is advantageous for improved use properties of the hot-working steel article at elevated temperatures is to be provided. The correspondingly provided individual and collective concentrations of the elements are recited above and in the appended claims, respectively.

It has proved advantageous to set the upper limit for the nitrogen content of the alloy at 0.025% by weight, because nitrogen forms stable nitrides with the carbide-forming elements Cr, Mo and V, which nitrides may cause disadvantages with respect to the thermal treatment.

A hot-working steel article with particularly high performance profile can be produced if the value of at least one of the following mechanical properties of the steel at a temperature of 500° C. is equal to or higher than:

impact strength: 180 J notched impact strength in longitudinal direction: Charpy-U 14 J and the hardness thereof at RT is at least 59 HRC.

The decisive advantages of a fine-grained microstructure with regard to a high material toughness with concomitant high hardness values can be obtained with the alloy according to the invention if the hardening temperature for the thermal treatment for setting the mechanical properties is lower than 1080° C., in particular 1050° C., plus/minus 10° C.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, wherein.

DETAILED DESCRIPTION OF THE PRESENT INVENTION

Figure 1:
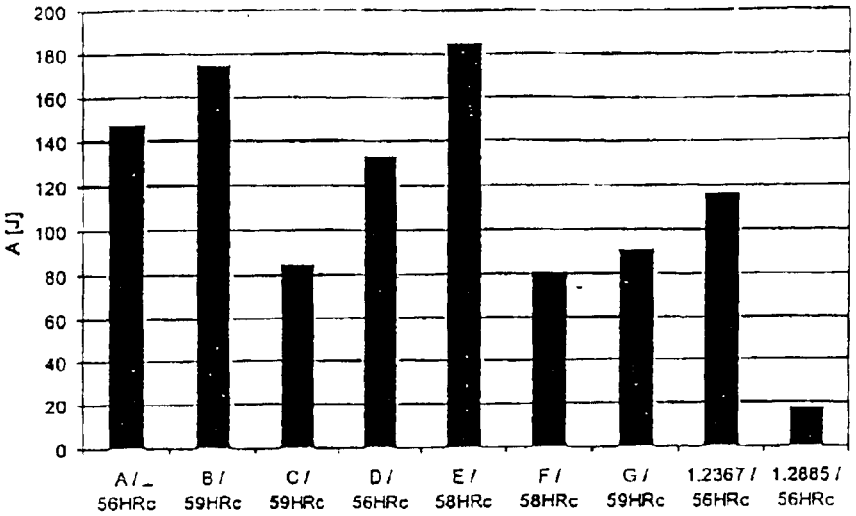
FIG. 1, FIG. 2 and FIG. 3 are bar diagrams illustrating the impact strength and the notched impact strength values at 20° C. and 500° C., respectively, of tested materials.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Table 1 provides the chemical compositions of some tested materials.

TABLE 1

| | Chemical composition in % by weight | | | | | | |
|---|---|---|---|---|---|---|---|
| Alloy | C | Si | Mn | Cr | V | Mo | Co |
| A | 0.39 | 0.23 | 0.32 | 4.27 | 0.52 | 2.90 | |
| B | 0.52 | 0.25 | 0.25 | 4.45 | 0.68 | 3.21 | |
| C | 0.43 | 0.28 | 0.24 | 4.48 | 0.58 | 4.36 | |
| D | 0.40 | 0.28 | 0.24 | 4.37 | 0.80 | 4.39 | |
| E | 0.48 | 0.30 | 0.26 | 4.48 | 0.56 | 3.10 | |
| F | 0.52 | 0.17 | 0.16 | 4.38 | 0.54 | 4.57 | |
| G | 0.53 | 0.29 | 0.26 | 4.51 | 0.84 | 4.56 | |
| 1.2367 | 0.38 | 0.35 | 0.32 | 5.07 | 0.67 | 2.83 | |
| ~1.2885 | 0.38 | 0.28 | 0.37 | 2.95 | 0.67 | 2.83 | 2.9 |

The materials in Table 1 labeled alloy B and alloy E have a composition according to the invention; samples with the material numbers according to the "DIN-Stahl-Eisen-Liste" (Steel Iron List) are labeled 1.2367 and 1.2885, with the latter sample being outside the prescribed limits for the carbon content.

In order to compare the mechanical properties of the materials with the different alloy compositions, attempts were made to heat-treat the respective test materials to a hardness of 58 to 59 HRC. In particular, testing was done by employing the measures given in Table 2, with oil being used as the quenching medium.

TABLE 2

| Alloy | Hardening Temperature/ Time | Thermal Treatment Temperature | Time | Number | Hardness HRC Achieved |
|---|---|---|---|---|---|
| A | 1100° C./30 min | 560° C. | 60 min | 3x | 56 |
| B | 1060° C./30 min | 560° C. | 60 min | 3x | 59 |
| C | 1100° C./30 min | 530° C. | 60 min | 3x | 59 |
| D | 1100° C./30 min | 560° C. | 60 min | 3x | 56 |
| E | 1060° C./30 min | 560° C. | 60 min | 3x | 58 |
| F | 1060° C./30 min | 550° C. | 60 min | 3x | 58 |
| G | 1060° C./30 min | 550° C. | 60 min | 3x | 59 |
| 1.2367 | 1100° C./30 min | 550° C./120 min + 560° C./120 min | | | 56 |
| ~1.2885 | 1100° C./30 min | 550° C./120 min + 560° C./120 min | | | 56 |

The materials according to DIN material numbers 1.2367 and 1.2885 could not be heat-treated to a hardness of higher than 56 HRC, not even by special methods.

The numerical values obtained when carrying out a mechanical testing of the alloys according to the invention (B, E) and of comparative materials can be seen in Table 3.

TABLE 3

| Alloy/Hardness | Impact Strength A [J] RT | Notched Impact Strength (ISO-U) KU [J] RT | Notched Impact Strength (ISO-U) KU [J] 500° C. |
|---|---|---|---|
| A/56HRC | 147.8 | 9.6 | — |
| B/57HRC | 175.0 | 11.3 | 15.8 |
| C/59HRC | 84.8 | 6.8 | — |
| D/56HRC | 133.5 | 8.3 | — |
| E/58HRC | 185.0 | 11.8 | 16.3 |
| F/58HRC | 80.8 | 8.0 | — |
| G/59HRC | 91.0 | 6.9 | — |
| 1.2367/56HRC | 116.8 | 11.5 | 16.8 |
| ~1.2885/56HRC | 17.8 | 5.3 | 12.3 |

Figure 2:
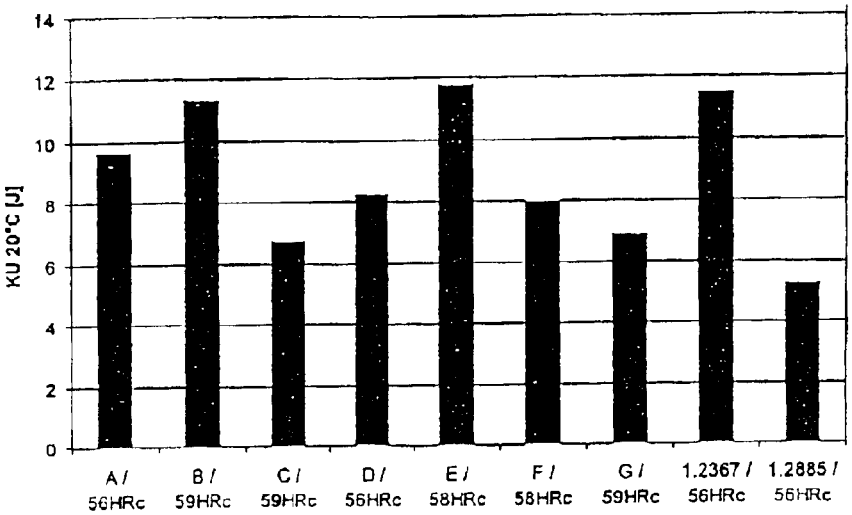
Figure 3:
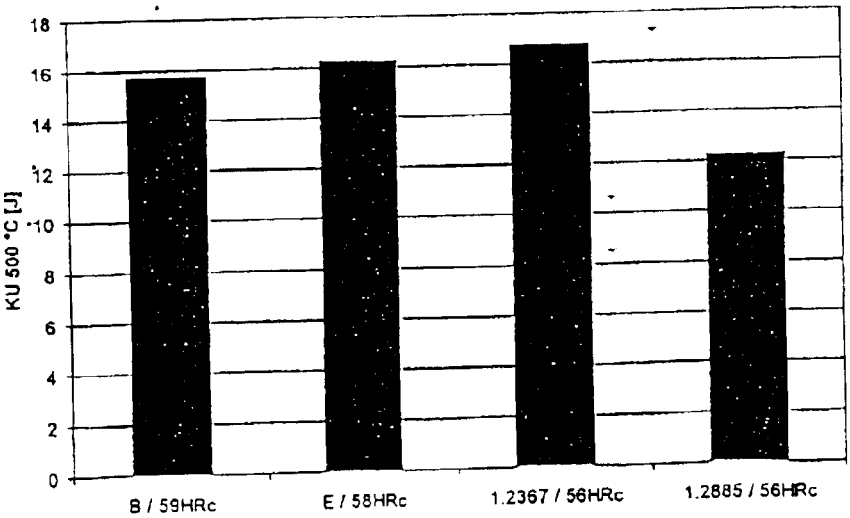

For an illustrative comparison, the obtained test values are represented graphically as bar diagrams in FIG. 1, FIG. 2 and FIG. 3.

As can be taken from FIG. 1 and FIG. 2, alloy A exhibits lowered hardness and impact strength and notched impact strength values compared with the alloys according to the invention, because evidently due to the low carbon content, no adequate matrix strength was achieved. The material of alloy C, on the other hand, has a high hardness, but a very low toughness, which indicates a low carbon content combined with a high molybdenum concentration, i.e., a matrix depletion. The same applies, to a lesser extent, to alloy D, where the increased vanadium content apparently masks the high molybdenum content with respect to the toughness, but results in a low hardness efficiency. Showing a good increase in hardness during the thermal treatment, the material of alloy F illustrates the full effect of high molybdenum contents with regard to a reduction in the toughness properties, in particular the impact strength. The same essentially applies also to the material of alloy G. The steel with the material number 1.2367 can be thermally treated to only low hardness values and shows a low retention of hardness due to the increased chromium content; a quite high notched impact strength of the material is accompanied by a comparatively low impact strength at RT. An extremely low property level was determined for the material no. 1.2885, which shows an improved retention of hardness.

FIG. 3 provides a comparison of the notched impact strengths (ISO-U) at 500° C. of the materials according to the invention of alloy B and E and materials with the material no. 1.2367 and 1.2885. The low hardness according to DIN standard materials promotes toughness; unexpectedly low KU values were determined for the steel with material no. 1.2885.

It can be seen from a comparison of the test results of the flexural impact strength at RT, the notched impact strength (ISO-U) at RT and the notched impact strength (ISO-U) at 500° C. of the tested materials, that after thermal treatment, the materials according to the invention have a high degree of hardness of at least 58 HRC and a superior level of mechanical properties. At the same time, advantageously low hardening temperatures can be used for the thermal treatment.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A hot-working steel article comprising a material which comprises, in % by weight:

| | |
|---|---|
| Carbon (C) | 0.451 to 0.598 |
| Silicon (Si) | 0.11 to 0.29 |
| Manganese (Mn) | 0.11 to 0.39 |
| Chromium (Cr) | 4.21 to 4.98 |
| Molybdenum (Mo) | 2.81 to 3.29 |
| Vanadium (V) | 0.41 to 0.69 |

with the balance being iron, contaminants and accompanying elements.

2. The article of claim 1, wherein the ratio C/V is 0.82 to 1.38.

3. The article of claim 1, wherein the ratio (Cr+Mo+V)/C is 15.2 to 18.4.

4. The article of claim 1, wherein the material comprises less than 0.1% by weight of tungsten.

5. The article of claim 1, wherein a content of carbides which are formed upon solidification of a melt on which the material is based is less than 0.45 vol.-%.

6. The article of claim 1, wherein the material comprises not more than 0.005% by weight of sulfur.

7. The article of claim 1, wherein the material comprises not more than 0.007% by weight of phosphorus.

8. The article of claim 1, wherein the material comprises not more than a total of 0.010% by weight of (sulfur+phosphorus).

9. The article of claim 1, wherein the material comprises not more than 0.15% by weight of nickel.

10. The article of claim 1, wherein the material comprises not more than 0.1% by weight of cobalt.

11. The article of claim 1, wherein the material comprises not more than 0.1% by weight of copper.

12. The article of claim 8, wherein the material comprises not more than a total of 0.25% by weight of (nickel+cobalt+copper).

13. The article of claim 1, wherein the material comprises not more than 0.02% by weight of aluminum.

14. The article of claim 1, wherein the material comprises not more than 0.001% by weight of magnesium.

15. The article of claim 1, wherein the material comprises not more than 0.001% by weight of calcium.

16. The article of claim 12, wherein the material comprises not more than a total of 0.02% by weight of (aluminum+magnesium+calcium).

17. The article of claim 16, wherein the material comprises not more than:

0.005% by weight of sulfur;
0.007% by weight of phosphorus;
0.15% by weight of nickel;
0.1% by weight of cobalt;
0.1% by weight of copper;
0.02% by weight of aluminum;
0.001% by weight of magnesium; and
0.001% by weight of calcium.

18. The article of claim 1, wherein the material comprises less than 0.025% by weight of nitrogen.

19. The article of claim 1, wherein the material comprises not more than 0.005% by weight of arsenic.

20. The article of claim 1, wherein the material comprises not more than 0.003% by weight of bismuth.

21. The article of claim 1, wherein the material comprises not more than 0.005% by weight of tin.

22. The article of claim 1, wherein the material comprises not more than 0.002% by weight of zinc.

23. The article of claim 1, wherein the material comprises not more than 0.002% by weight of antimony.

24. The article of claim 1, wherein the material comprises not more than 0.002% by weight of boron.

25. The article of claim 16, wherein the material comprises not more than a total of 0.009% by weight of (arsenic+bismuth+tin+zinc+antimony+boron).

26. The article of claim 1, wherein the material comprises not more than:

0.005% by weight of arsenic;
0.003% by weight of bismuth;
0.005% by weight of tin;
0.002% by weight of zinc;
0.002% by weight of antimony; and
0.002% by weight of boron.

27. The article of claim 1, wherein the material has a hardness of at least 58 HRC, an impact strength of at least 170 J and a notched impact strength (Charpy U) in longitudinal direction of at least 11 J.

28. The article of claim 1, wherein the material has a hardness of at least 59 HRC at room temperature, and at a temperature of 500° C. shows at least one of an impact strength of at least 180 J and a notched impact strength (Charpy U) in longitudinal direction of at least 14 J.

29. The article of claim 27, wherein the material has been heat-treated at a temperature below 1080° C.

30. The article of claim 29, wherein the material has been heat-treated at a temperature in the range of 1040° to 1060° C.

31. The article of claim 1, wherein the article is a tool.

32. The article of claim 1, wherein the tool is selected from extrusion die matrices, forging tools, die casting dies, extrusion dies, and mandrels.

33. The article of claim 29, wherein the article is a tool for forming metals and alloys at elevated temperatures.

34. An alloy for a hot-working steel article, wherein the alloy comprises, in % by weight:

| | |
|---|---|
| Carbon (C) | 0.451 to 0.598 |
| Silicon (Si) | 0.11 to 0.29 |
| Manganese (Mn) | 0.11 to 0.39 |
| Chromium (Cr.) | 4.21 to 4.98 |
| Molybdenum (Mo) | 2.81 to 3.29 |
| Vanadium (V) | 0.41 to 0.69; |

with the balance being iron, contaminants and accompanying elements; and wherein the ratio C/V is 0.82 to 1.38 and the ratio (Cr+Mo+V)/C is 15.2 to 18.4.

35. The alloy of claim 34, wherein the alloy comprises less than 0.1% by weight of tungsten.

36. The alloy of claim 34, wherein the alloy comprises not more than, in percent by weight:

0.005% by weight of sulfur;
0.007% by weight of phosphorus;
a total of 0.010% by weight of (sulfur+phosphorus);
0.15% by weight of nickel;
0.1% by weight of cobalt;
0.1% by weight of copper;
a total of 0.25% by weight of (nickel+cobalt+copper);
0.02% by weight of aluminum;
0.001% by weight of magnesium;
0.001% by weight of calcium; and
a total of 0.02% by weight of (aluminum+magnesium+calcium).

37. The alloy of claim 34, wherein the alloy comprises not more than, in percent by weight:

0.005% by weight of arsenic;
0.003% by weight of bismuth;
0.005% by weight of tin;
0.002% by weight of zinc;
0.002% by weight of antimony; and
0.002% by weight of boron;
the sum of (arsenic+bismuth+tin+zinc+antimony+boron) not exceeding 0.009% by weight.

38. The alloy of claim 34, wherein the alloy comprises less than 0.025% by weight of nitrogen.

39. A process for making a hot-working steel article, wherein an article comprising a material which comprises, in % by weight:

| | |
|---|---|
| Carbon (C) | 0.451 to 0.598 |
| Silicon (Si) | 0.11 to 0.29 |
| Manganese (Mn) | 0.11 to 0.39 |
| Chromium (Cr) | 4.21 to 4.98 |
| Molybdenum (Mo) | 2.81 to 3.29 |
| Vanadium (V) | 0.41 to 0.69; |

with the balance being iron, contaminants and accompanying elements, is heat-treated at a temperature below 1080° C. to a hardness of the material of at least 58 HRC, an impact strength of at least 170 J and a notched impact strength (Charpy U) in longitudinal direction of at least 11 J.

40. The process of claim 39, wherein the temperature is in the range of 1040° to 1060° C.

41. The process of claim 40, wherein the article is heat-treated to a hardness of the material of at least 59 HRC at room temperature, and to at least one of an impact strength of at least 180 J and a notched impact strength (Charpy U) in longitudinal direction of at least 14 J, both at a temperature of 500° C.

42. The process of claim 39, wherein the ratio C/V of the material is 0.82 to 1.38.

43. The process of claim 42, wherein the ratio (Cr+Mo+V)/C of the material is 15.2 to 18.4.

44. The process of claim 43, wherein the material comprises less than 0.1% by weight of tungsten.

45. The process of claim 39, wherein the material comprises not more than, in percent by weight:

0.005% by weight of sulfur;

0.007% by weight of phosphorus;

a total of 0.010% by weight of (sulfur+phosphorus);

0.15% by weight of nickel;

0.1% by weight of cobalt;

0.1% by weight of copper;

a total of 0.25% by weight of (nickel+cobalt+copper);

0.02% by weight of aluminum;

0.001% by weight of magnesium;

0.001% by weight of calcium; and a total of 0.02% by weight of (aluminum+magnesium+calcium).

46. The process of claim 45, wherein the material comprises not more than, in percent by weight:

0.005% by weight of arsenic;

0.003% by weight of bismuth;

0.005% by weight of tin;

0.002% by weight of zinc;

0.002% by weight of antimony; and 0.002% by weight of boron;

the sum of (arsenic+bismuth+tin+zinc+antimony+boron) not exceeding 0.009% by weight.

47. The process of claim 45, wherein the material comprises less than 0.025% by weight of nitrogen.

* * * * *